US009500348B2

(12) United States Patent
Callister

(10) Patent No.: US 9,500,348 B2
(45) Date of Patent: Nov. 22, 2016

(54) BODY TREATMENT TOOLS

(71) Applicant: Christopher T. Callister, Bend, OR (US)

(72) Inventor: Christopher T. Callister, Bend, OR (US)

(73) Assignee: UPRIGHT INDUSTRIES MANUFACTURING, Bend, OR (US)

( * ) Notice: Subject to any disclaimer, the term of this patent is extended or adjusted under 35 U.S.C. 154(b) by 210 days.

(21) Appl. No.: 14/186,539

(22) Filed: Feb. 21, 2014

(65) Prior Publication Data

US 2015/0241041 A1 Aug. 27, 2015

(51) Int. Cl.

| | |
|---|---|
| ***A47B 37/00*** | (2006.01) |
| ***F21V 21/22*** | (2006.01) |
| ***A47B 96/02*** | (2006.01) |
| ***A61G 13/12*** | (2006.01) |
| ***A61G 15/12*** | (2006.01) |
| ***F21V 21/26*** | (2006.01) |
| ***A61G 13/10*** | (2006.01) |
| ***A61G 15/16*** | (2006.01) |
| *A61G 5/12* | (2006.01) |

(52) U.S. Cl.

CPC ..... *F21V 21/22* (2013.01); *A47B 96/025* (2013.01); *A61G 13/10* (2013.01); *A61G 13/101* (2013.01); *A61G 13/1235* (2013.01); *A61G 15/12* (2013.01); *A61G 15/16* (2013.01); *F21V 21/26* (2013.01); *A61G 2005/125* (2013.01)

(58) Field of Classification Search

CPC ..... A47C 7/70; A47C 7/68; A47B 83/02; A47B 3/14; A47B 39/00; A47B 2200/0085;A47B 21/0314; A47B 23/02; A47B 23/04; F16M 11/2014; F16M 11/12; A61G 15/14

USPC ..... 297/173, 162; 108/42, 50.14, 50.16, 108/134, 135, 97, 98, 140, 102, 103, 105, 108/141; 248/443, 447.1, 447.2, 291.1, 248/413, 295.11

See application file for complete search history.

(56) References Cited

U.S. PATENT DOCUMENTS

| | | | | | |
|---|---|---|---|---|---|
| 527,056 | A | * | 10/1894 | Gilson | A47D 15/006 297/408 |
| 1,682,180 | A | * | 8/1928 | Merrill | A47B 23/025 248/285.1 |
| 2,026,011 | A | * | 12/1935 | Wright | A47B 23/02 108/141 |
| 2,143,005 | A | * | 1/1939 | Green | F16B 7/182 248/413 |

(Continued)

FOREIGN PATENT DOCUMENTS

| | | | |
|---|---|---|---|
| DE | 1805515 | * | 5/1970 |
| DE | 3311161 | * | 9/1984 |

OTHER PUBLICATIONS

PCT International Search Report—Corresponding PCT Application No. PCT/US2015/016668, dated Jul. 10, 2015, 10 pages.

*Primary Examiner* — Janet M Wilkens

(74) *Attorney, Agent, or Firm* — Leber IP Law

(57) ABSTRACT

Disclosed herein are tools and sets of tools that alleviate non-ergonomic positions of a practitioner, such as a body artist, cosmetician, or medical practitioner, and a subject to whom a treatment is being applied by the practitioner. These tools include body support devices, articulating and positionable trays that are designed to hold implements that will be used in the treatment, and positionable lighting systems.

9 Claims, 20 Drawing Sheets

(56) References Cited

U.S. PATENT DOCUMENTS 2,327,990 A * 8/1943 Benson ..... E04H 12/182 24/115 G
2,954,955 A 10/1960 Feller
3,311,411 A 3/1967 Page et al.
3,348,799 A * 10/1967 Junkel ..... A61G 15/14 108/141
3,601,443 A 8/1971 Jones
3,712,669 A 1/1973 Cates
4,111,575 A * 9/1978 Hoshino ..... F16B 7/1418 248/413
4,136,908 A 1/1979 Crayne
4,161,345 A * 7/1979 Begun ..... A47B 17/03 248/188.1
4,405,107 A * 9/1983 Clyburn ..... F16B 7/1418 248/230.4
4,546,708 A * 10/1985 Wilburth ..... A47B 11/00 108/103
4,562,987 A * 1/1986 Leeds ..... F16M 11/048 248/278.1
4,687,167 A * 8/1987 Skalka ..... A47B 21/0314 108/103
4,856,741 A * 8/1989 Schaefer ..... A61B 6/00 108/20
5,429,336 A * 7/1995 Ko ..... F16M 11/04 248/278.1
5,653,499 A * 8/1997 Goodall ..... A47C 7/70 297/170
5,893,607 A * 4/1999 Trimnell ..... A47C 7/70 108/27
D488,163 S * 4/2004 Hunt ..... D14/452
6,748,873 B2 6/2004 Brown, Sr.
7,222,826 B1 * 5/2007 Berglund ..... A47B 21/0314 248/118
7,823,520 B2 11/2010 Mayben
8,191,487 B2 6/2012 Theesfeld
9,140,406 B2 * 9/2015 Simon
2006/0032417 A1 2/2006 Goschy et al.
2006/0278770 A1 12/2006 MacLeod
2007/0266912 A1 11/2007 Swain
2010/0294907 A1 * 11/2010 Kocher ..... A47J 33/00 248/413
2011/0240078 A1 10/2011 Lenhart et al.
2012/0193488 A1 * 8/2012 Chung ..... F16M 11/10 248/201

* cited by examiner

BODY TREATMENT TOOLS

BACKGROUND

In certain professions, such as body artistry, cosmetology, surgery, physical therapy and veterinary medicine, a practitioner applies a treatment to a portion of the body of a subject, e.g., a human or animal. Often, these treatments may be uncomfortable and/or non-ergonomic for the practitioner and/or the subject.

SUMMARY

Generally, this invention relates to tools for applying body treatments to a subject. These tools are designed to improve the ergonomics of such body treatments, both for the subject and for the practitioner applying the treatment. In some implementations, the tools are also portable and/or autoclavable to allow the tools to be sterilized.

The term "body treatments," as used herein, includes medical and non-medical, e.g. cosmetic, treatments of humans, and veterinary treatments. For example body treatments include surgery, non-surgical medical procedures, body art, piercing or other elective procedures.

In one aspect, the invention features an implement tray system comprising (a) an elongated arm member having two ends and a receiving opening at each end, (b) a tray having a bottom surface, (c) a first elongated cylindrical support member extending from the bottom surface of the tray generally perpendicular to the surface, the support member being removably received in one of the receiving openings, mounting the tray on the elongated arm member, and (d) a second elongated cylindrical support member that is removably received in the other of the receiving openings.

Some implementations may include one or more of the following features. The system may include a second elongated arm member having two ends and a receiving opening at each end, wherein the second cylindrical support member is removably received in one of the openings in the second elongated arm member. The receiving openings of the first and second elongated support members may all have the same diameter.

In some implementations, the system may include a friction fitting at each end of the elongated arm member, the friction fittings being configured to allow a user to adjust the freedom of movement of the ends relative to the cylindrical support members. The friction fitting may comprise a friction collar and a setscrew that bears on the collar, causing the collar to apply pressure to the cylindrical support member.

In some implementations, the friction fitting may further comprise a bracket that is fixedly mounted to the end of the elongated arm member and that defines the receiving opening, wherein the friction collar is disposed within the bracket and the setscrew extends through an opening in the bracket.

In another aspect, the invention features a lighting system comprising (a) a light source, (b) an elongated positionable support having two ends, the light source extending from one end, (c) a base at the other end of the support, and (d) a mounting member on which the base is pivotably mounted such that a user can rotate the light source about an axis of rotation that is generally perpendicular to a long axis of the support.

Some implementations may include one or more of the following features. The support may comprise a plurality of telescoping elongated members.

In some implementations, the base may comprise a plate that is configured to rotate on a surface of the mounting member. The base and/or mounting member may comprise a plurality of stops to limit rotation to predetermined positions.

In some implementations, the light source may comprise a plurality of lamps.

In some implementations, the positionable support may comprise a length of gooseneck tubing.

In some implementations, the mounting member and/or the base may have a battery compartment.

In some implementations, the system may further comprise a port configured to removably receive a power cord.

In another aspect, the invention features a body support device comprising (a) a body rest configured to support an appendage of a patient, the body rest having an upper and lower surface, (b) a vertical member having two ends, the lower surface of the body support being pivotably attached to one end, and (c) a horizontal member attached at the other end of the vertical member, the horizontal member being configured to attach to an object on which the patient is positioned; wherein at least one of the vertical member and horizontal member is configured to be adjustable in length and/or rotational position.

Some implementations may include one or more of the following features. The object may be selected from a group consisting of chairs, tables, and beds.

In some implementations, the body rest may be configured to support an arm of the patient.

In some implementations, the vertical member may be configured to be adjustable in length so as to allow adjustment of the height of the body rest.

In some implementations, the horizontal member may be configured to be adjustable in length so as to allow adjustment of the horizontal distance of the body rest from the object.

In some implementations, the body rest may be configured for multi-axis adjustability.

In another aspect, the horizontal member may be configured to pivot about a vertical axis.

In some implementations, the horizontal member can be pivoted to extend on either side of the object.

In another aspect, the invention features kits including two or more of the tools disclosed herein. For example, the invention features a kit for applying treatments to a subject, the kit comprising (a) a body support device comprising a body rest, an attachment system configured to attach the body support device to a chair, and, mounted on the attachment system, an adjustment system configured to support the body rest and allow the position of the body rest to be adjusted, and (b) an implement tray system that includes an implement tray, a positionable support system on which the tray is mounted, and a base configured to removably secure the support system to an object. The kit may further include a lighting system.

The kits may be packaged so as to be easily transportable by the practitioner to a remote site, and the tools may include any of the features described herein.

The invention also features methods of using the tools described herein.

DETAILED DESCRIPTION

Disclosed herein are tools and sets of tools that alleviate non-ergonomic positions of a practitioner, such as a body artist, cosmetician, or medical practitioner, and a subject to whom a treatment is being applied by the practitioner. These tools include body support devices, articulating and positionable trays that are designed to hold implements that will be used in the treatment, and positionable lighting systems. In some implementations the tools are portable and thus can be used by the practitioner at remote sites such as trade shows, sporting events, festivals, a subject's home, and the like. Each of these tools will be discussed in more detail below.

Body Support Device

The body support devices discussed below and shown in FIGS. 1-6 are designed to adjustably position a body part of a recipient of a treatment in a position that is ergonomic both for the recipient and the practitioner who is applying the treatment. The adjustability of the position of the body part allows the practitioner to position the patient so that the treatment can be applied without undue strain or discomfort to the practitioner or recipient. The body support devices include a body support, which may be contoured and/or cushioned or padded for comfort of the recipient (e.g., with foam, gel, or elastomeric material.) The body support devices also include an attachment system configured to allow the body support device to be mounted on a chair, and an adjustment system that allows the position of the body support relative to the chair to be adjusted. In a first embodiment, shown in FIGS. 1-3, the body support device is mounted semi-permanently to the chair, e.g., by bolting it to drilled holes in the base of the chair. In alternate embodiments, shown in FIGS. 5 and 6, the body support device is more easily attachable and removable, allowing it to be portable, e.g., for use at trade shows and other locations. In these embodiments, the body support devices are also adjustable for attachment to different sizes and shapes of chairs.

Figure 1:
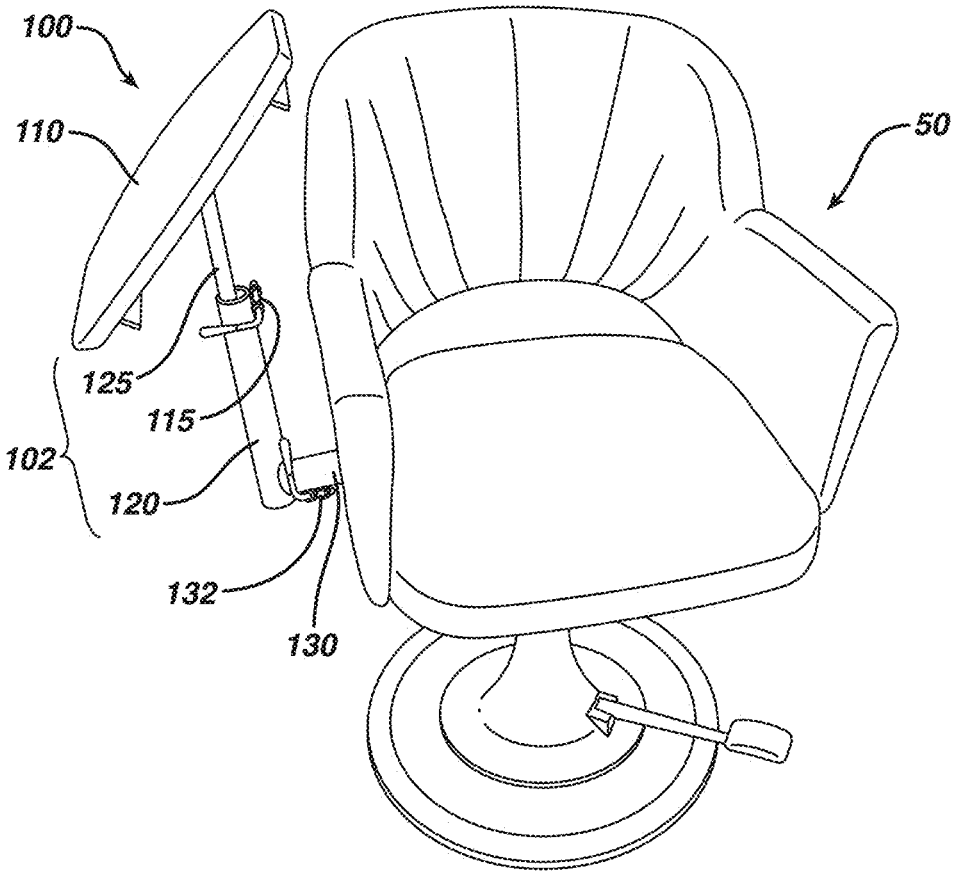
FIG. 1 is a perspective view of a body support device attached to a chair in one orientation.

A body support device 100 is shown in FIG. 1, which includes an adjustable attachment system 102 and a body support 110, e.g., a padded or contoured rest configured to support a body part such as an arm, adjustably positioned at one end of the adjustable attachment system 102.

Figure 2:
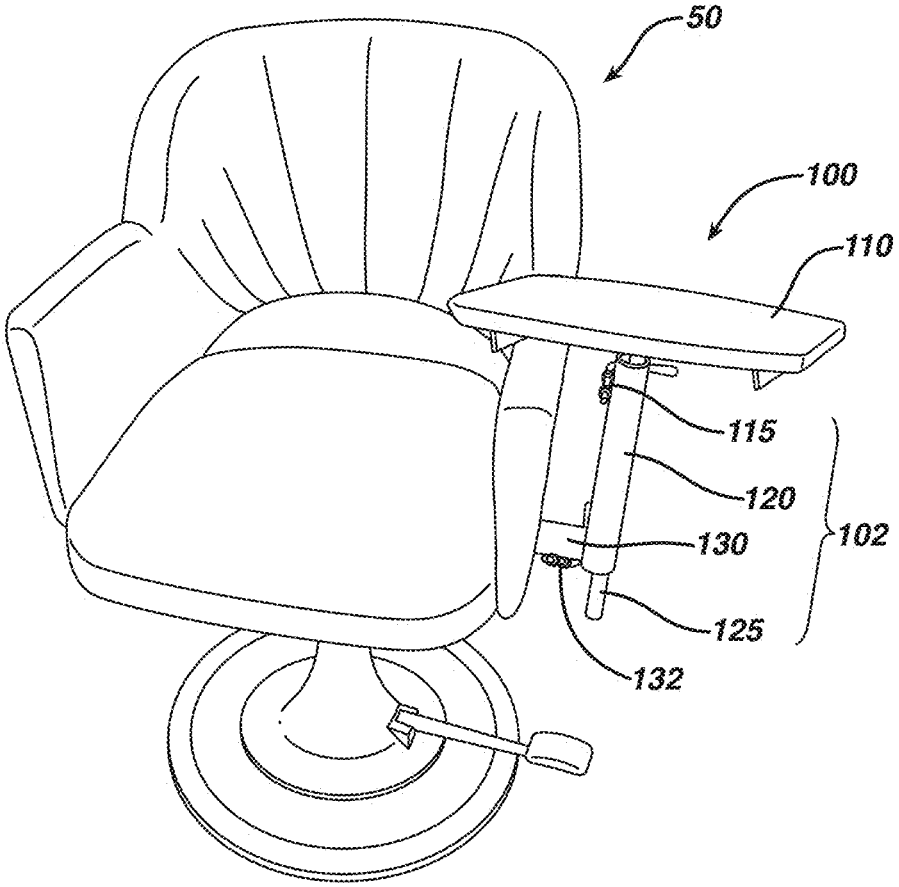
FIG. 2 is a perspective view of the body support device attached to a chair in a second orientation.
Figure 3:
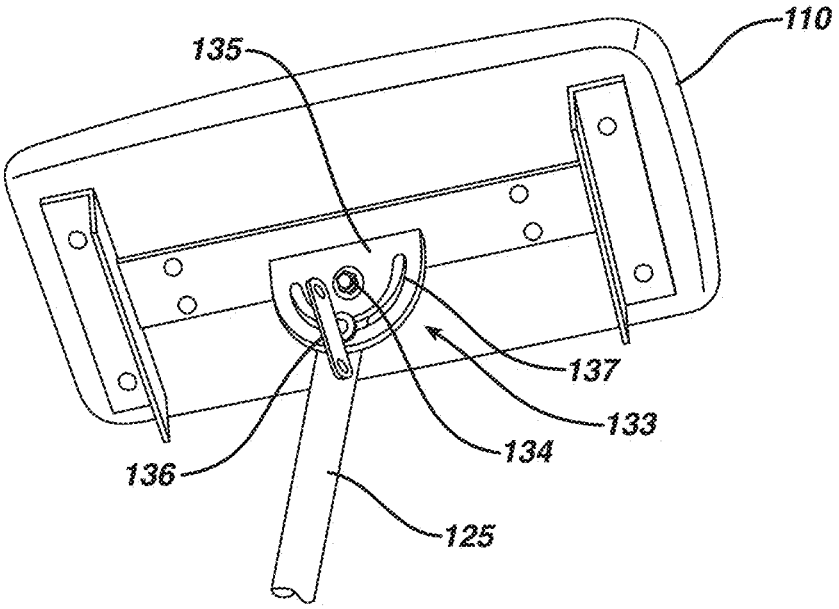
FIG. 3 is a perspective view of the underside of the body support.
Figure 4:
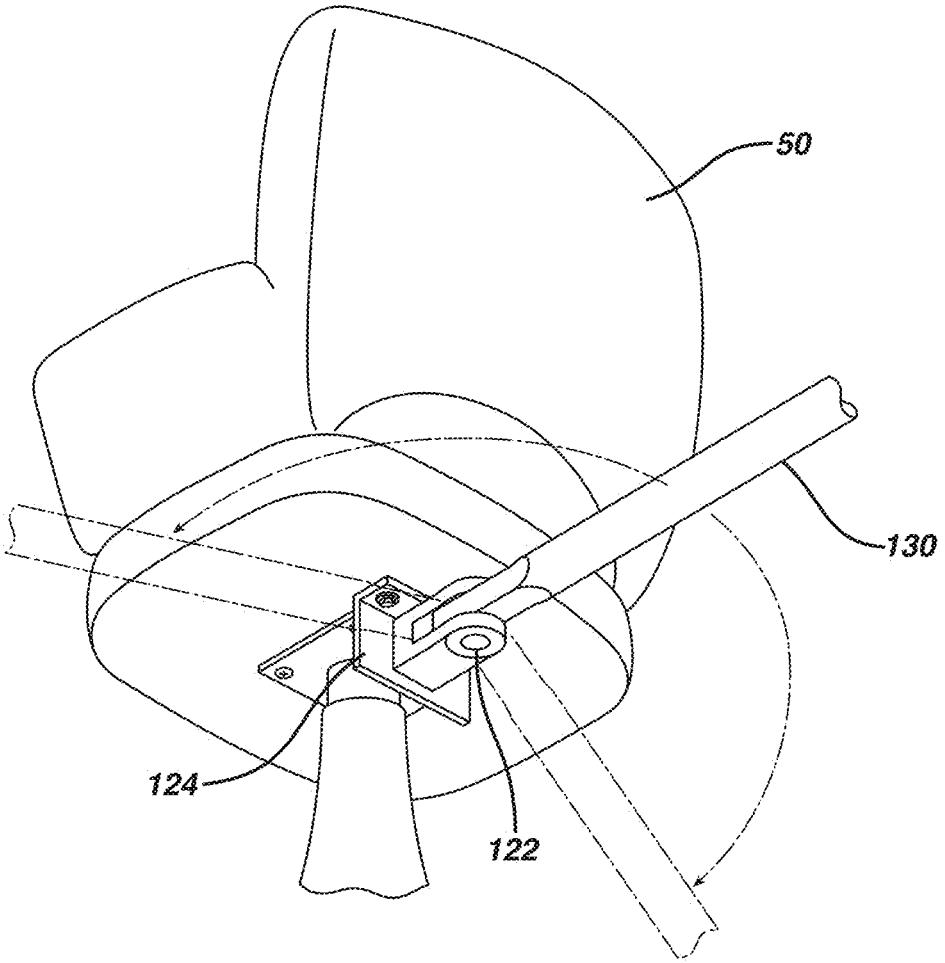
FIG. 4 is a perspective view of the underside of the chair to which the body support is mounted.

Referring to FIGS. 1-3, the body support device 100 is intended to be semi-permanently attached to a chair 50. Preferably, the body support device 100 is attached to chair 50 that features a single support. As shown in FIG. 4, a bracket 124 is attached to the bottom surface of the chair seat, e.g., by bolts or screws.

As seen in FIGS. 2 and 4, the body support device 100 includes a horizontal member 130 that at one end is pivotably attached to the chair 50. The pivot 122 allows the horizontal member 130 to rotate approximately 270°. This rotational ability allows the horizontal member to be positioned on either side of the chair as indicated by the arrows in FIG. 4. The distance to which the distal end of horizontal member 130 extends from the pivot 122 is preferably adjustable, e.g., by providing a telescoping arrangement (not shown) the adjustment of which can be controlled by the user, e.g., using a quick release cam 132 (FIGS. 1-2).

As shown in FIG. 2, a vertical member 120 is fixedly attached at the distal end of the horizontal member 130. The vertical member 120 is a cylindrical tube that is open at both ends. A second vertical member 125 is dimensioned to be received by the first vertical member 120 in a telescoping arrangement. A friction device 115 is configured on the vertical member 120 to allow the user to adjust the height of the second vertical member 125 that extends from the vertical member 120. The friction device 115, e.g. a quick release cam, can removeably secure the second vertical member 125 with respect to the first vertical support member 120. Opening the friction device 115 allows movement of the second vertical member that enables adjustment of the height of the body support 110.

Body support 110 is pivotably attached at one end of the second vertical member 125. Referring to FIG. 3, pivot 133 is located at the intersection of the second vertical member 125 and the underside of the body support 110. The pivot 133 includes a plate 135 that is fixedly attached to the underside of the body support 110 and bolted to the distal end of second vertical member 125 by a bolt 134. The plate 135 defines an arcuate groove 137 that allows the body support 110 to pivot about a pivot axis along the axis of bolt 134 when the setscrew 136 is loosened. Thus, the user can readily adjust the angular position of the body support 110 with respect to the second vertical member 125 simply by loosening the setscrew. In combination with the rotatability of the second vertical member 125 with respect to the vertical member 120, this pivoting provides multi-axis adjustability of the position of the body support 110. Body support 110 can be held in a desired position by tightening setscrew 136.

Temporary/Transportable Body Support Device

Figure 5:
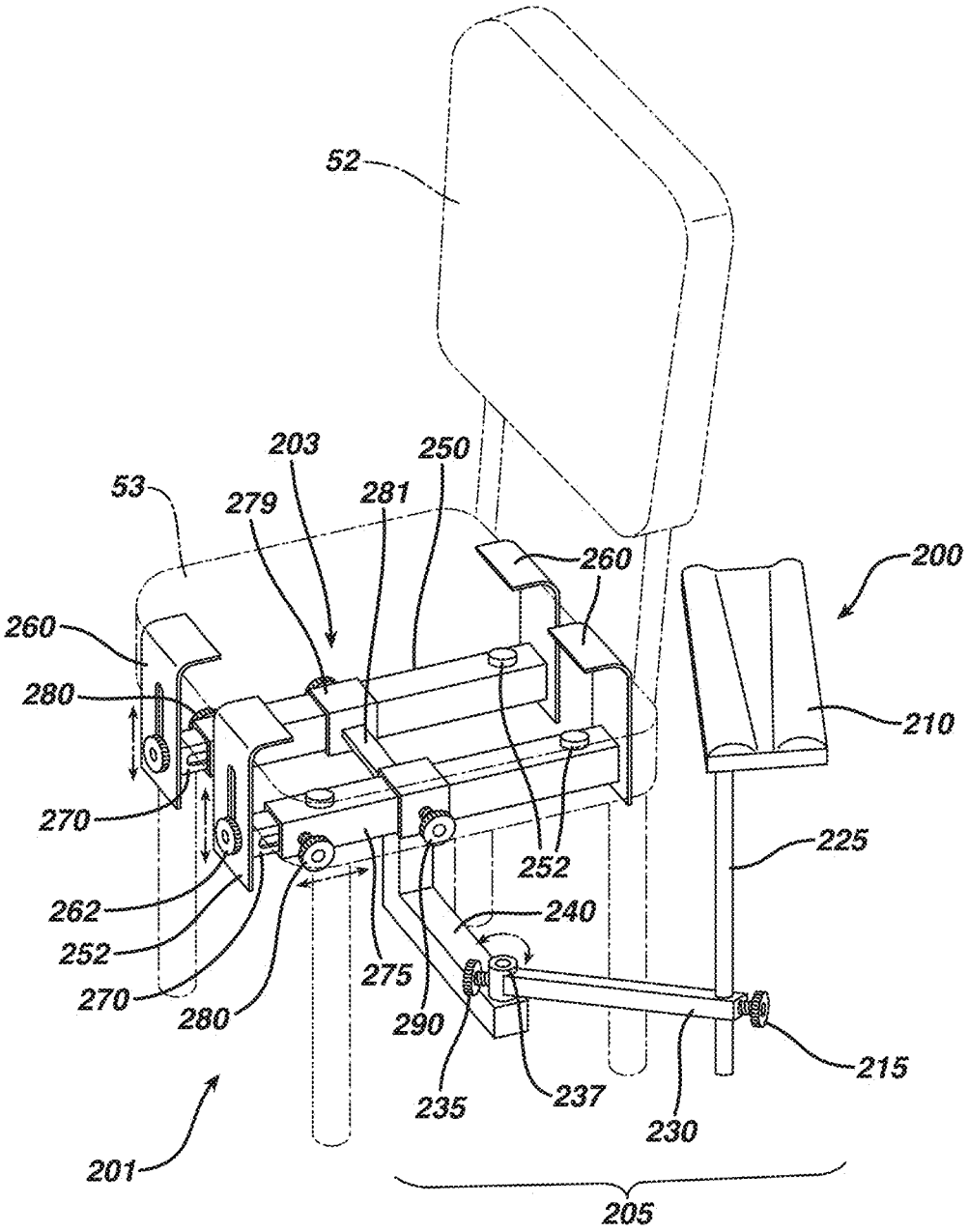
FIG. 5 is a perspective view of an alternate embodiment of the body support device. The device is shown mounted on a chair, which is shown as transparent.

An alternate embodiment of the body support device can be configured to be easily transportable and attachable to any standard chair 52. Referring to FIG. 5, body support device 201 includes an attachment system 203, an adjustment system 205, and a body support 200. Body support 200 has contoured features, e.g. elongated pads 210, which help further stabilize the body part during a procedure. The adjustment system 205 and the body support 200 can be easily positioned to either side of the chair and locked in place by arranging the attachment system 203 either as shown in FIG. 5 or in the opposite direction so that the attachment system extends on the opposite side of the chair.

Referring to FIG. 5, the adjustment system 205 includes articulating members that allow the position of the body support 200 to be adjusted. Vertical member 225 extends from the lower surface of the body support 200. The body support may be pivotably mounted on the vertical member as described above and shown in FIG. 3, or adjustable in any desired manner. Horizontal member 230 has an opening that receives vertical member 225. Friction screw 215 is configured to apply a force to the vertical member 225 allowing for vertical and rotational adjustment of the position of vertical member 225. Horizontal member 230 is pivotably attached to support member 240. Friction screw 235 is configured to removably apply a force to pivot 237 allowing for rotational adjustment of the position of horizontal member 230 about the pivot. Adjustment screws 290, 292 allow lockable adjustment of support member 240 along horizontal member 275. Spacers 252 provide clearance from the bottom of the chair to allow for movement of support member 240.

The attachment system 203 allows the user to attach the body support device to chairs having different sized seats. Clamp piece 260 is configured to extend over a portion of the horizontal seat surface 53. Locking screw 262 allows the user to adjust for differing seat thicknesses. Horizontal adjustment member 270 is attached to clamp member 260 at one end and is configured to be received by horizontal member 275. Locking screw 280 fixes horizontal adjustment member 270 with respect to horizontal member 275 enabling adjustment to accommodate chairs having different seat lengths.

Figure 6:
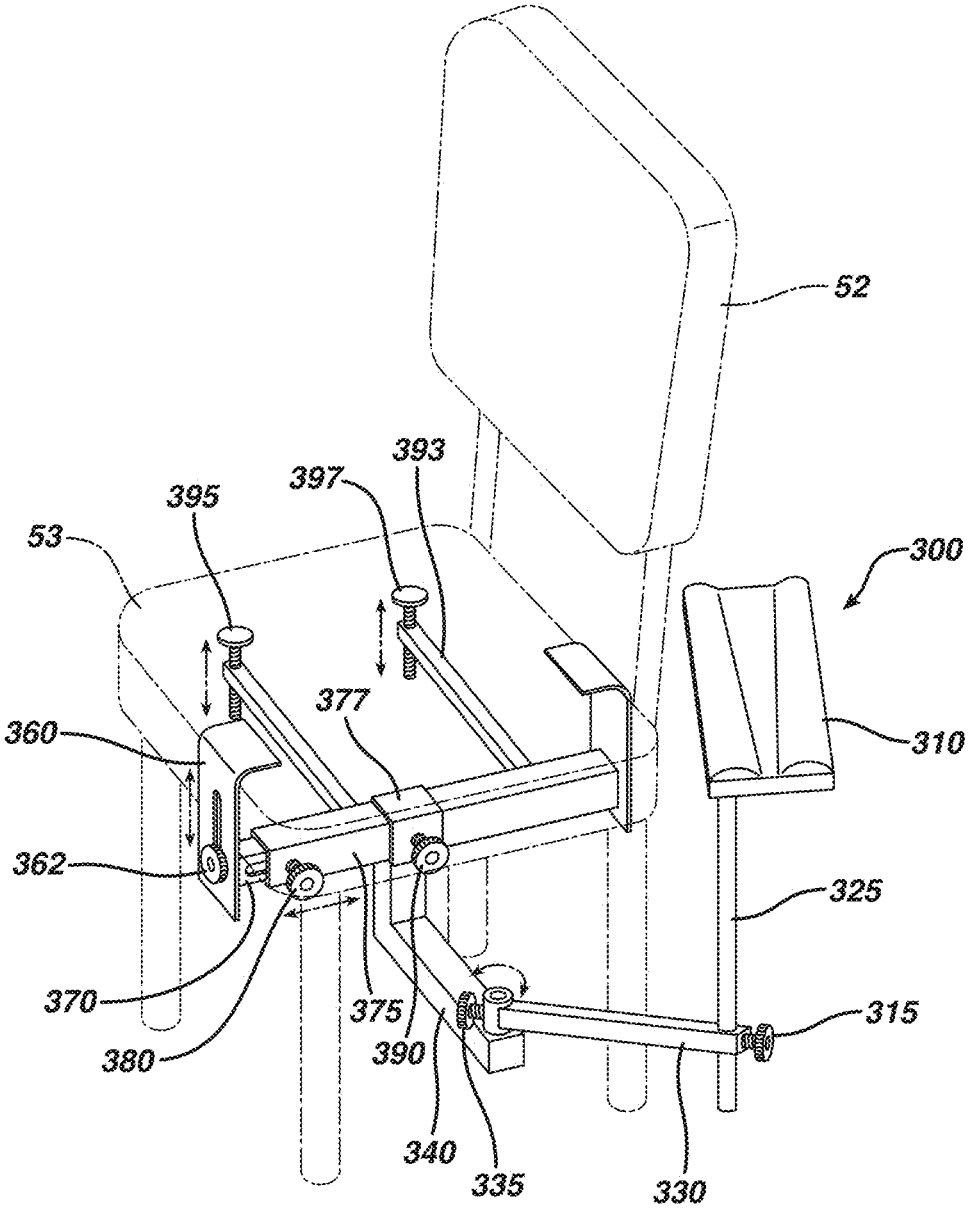
FIG. 6 is a perspective view of another alternate embodiment of the body support.

Referring to FIG. 6, an alternate embodiment of a transportable body support rest 300 is shown. This embodiment has similar adjustability features, but has a simplified manner of attaching to a chair.

In this embodiment, a single clamp piece 360 is configured to extend over a portion of the horizontal seat surface 53. Locking screw 362 allows the user to adjust for differing seat thicknesses. Horizontal adjustment member 370 is attached to clamp member 360 at one end and is configured to be received by horizontal member 375. Locking screw 380 fixes horizontal adjustment member 370 with respect to horizontal member 375 enabling adjustment to accommodate different sizes of chairs. Support members 392, 393 are affixed to horizontal member 375 and extend laterally. Adjustment screws 395, 397 are adjusted so that support members 392, 393 are generally horizontal, causing the adjustment screws to press up against the bottom of the seat, resisting the downward force applied by the cantilevered members 330 and 340. In this embodiment it is only necessary to loosen screw 362 in order to remove the support mechanism from a chair.

Implement Tray System

FIGS. 7-13 show an implement tray system 500 that is designed to allow the position of an implement tray to be widely adjustable to enhance the ergonomics of delivering a treatment to a subject. The tray system can be mounted at a convenient location, and then the tray can be moved between many positions while the practitioner works, so that the practitioner does not need to reach for implements while working. The system is also designed to allow all components of the system to be sterilized, and to allow the system to be portable and mounted in a variety of different ways.

Figure 9:
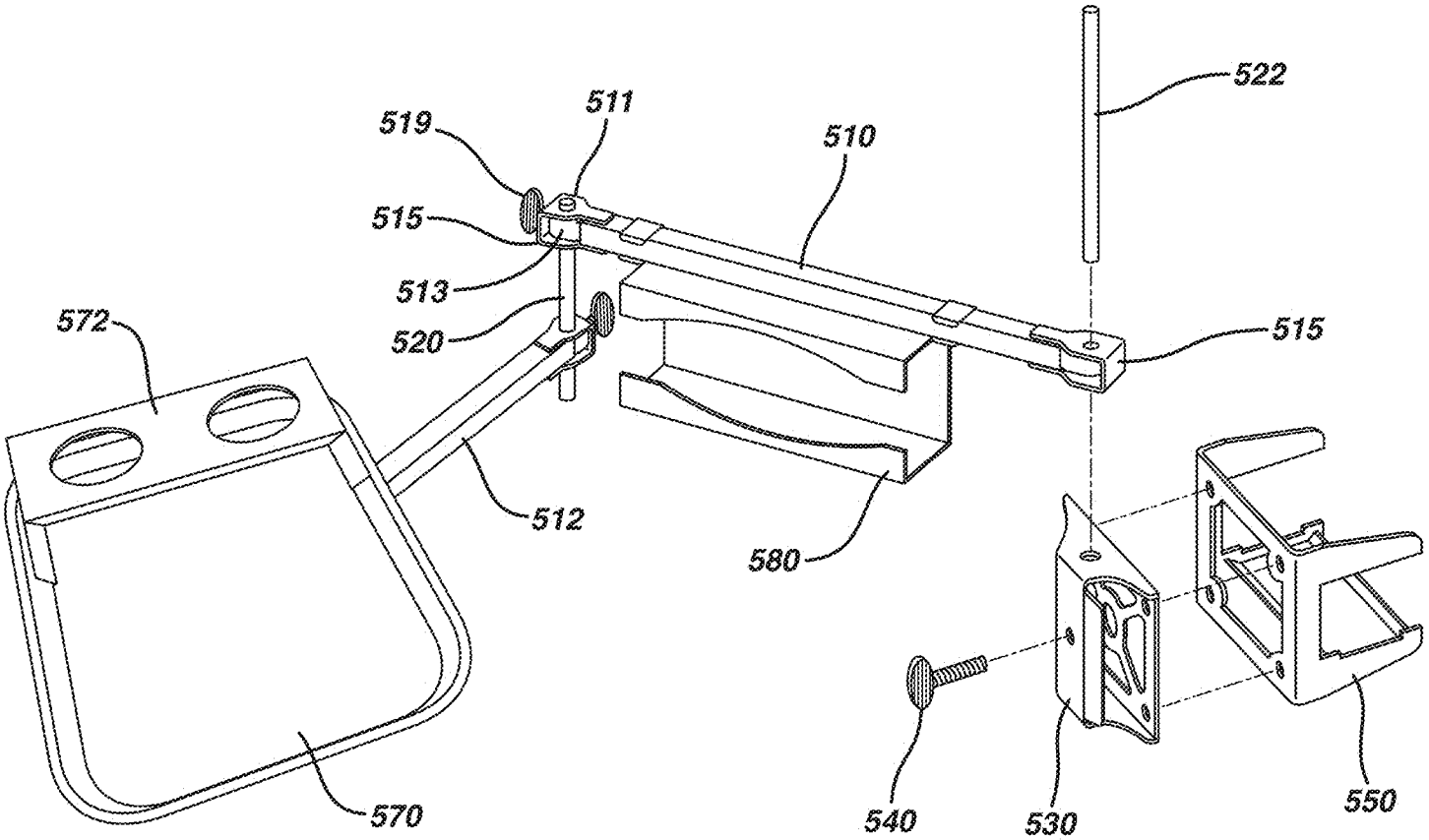
FIG. 9 is a partially exploded, perspective view of the implement tray system.
Figure 10:
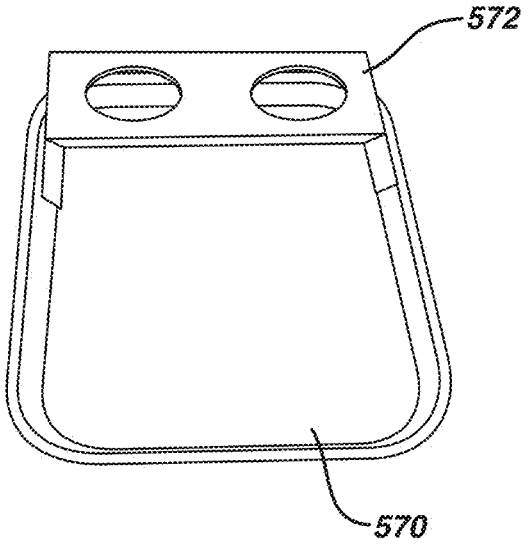
FIG. 10 is a perspective view of the implement tray.
Figure 11:
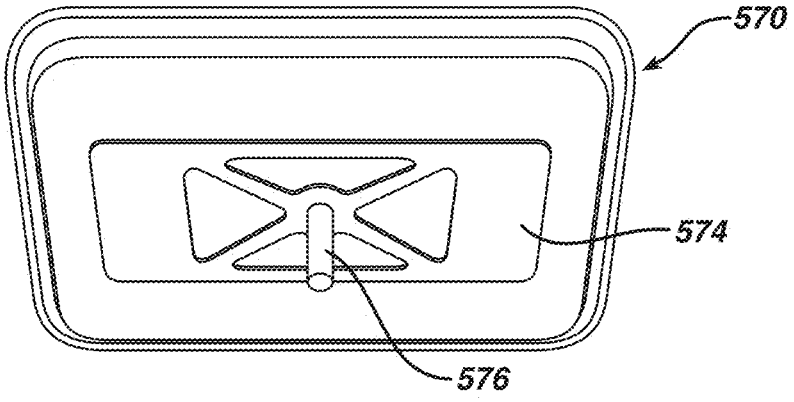
FIG. 11 is a perspective view of the tray from below.
Figure 12:
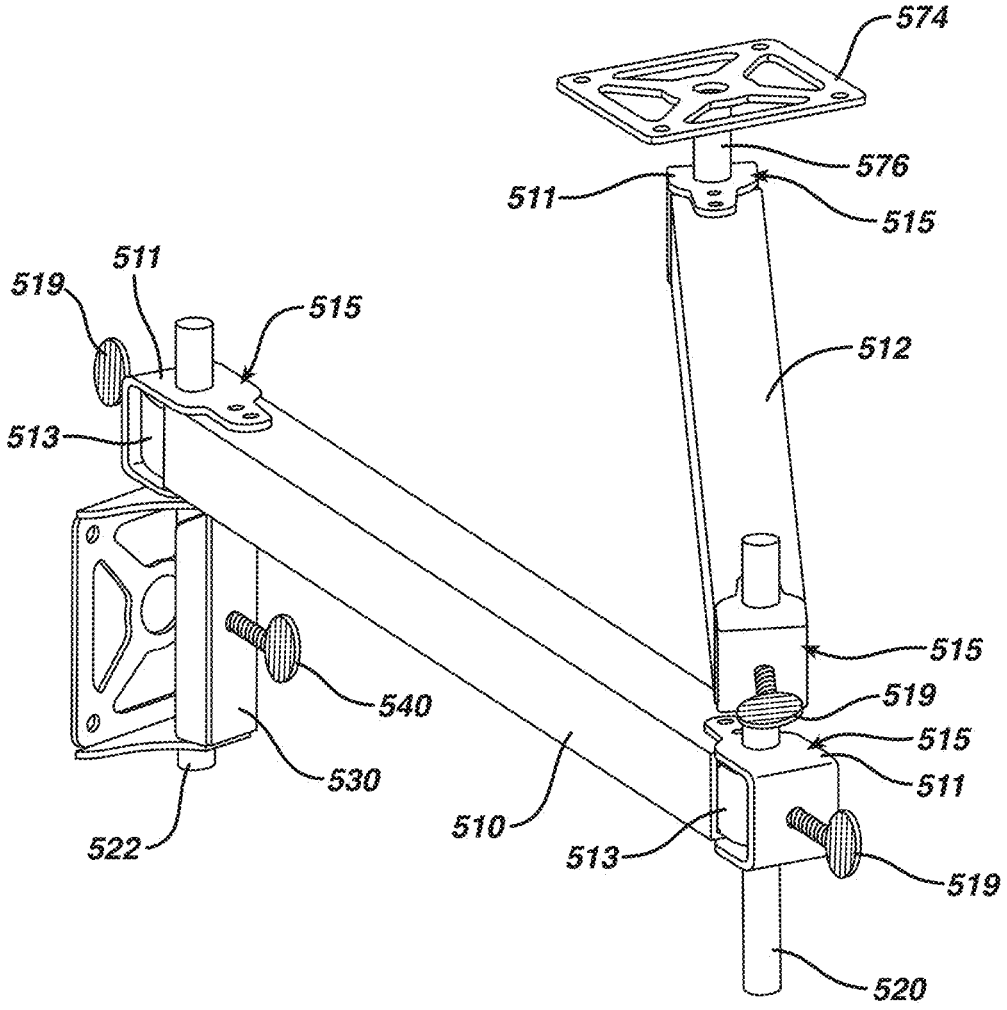
FIG. 12 is a perspective view of the articulating portion of the implement tray system.
Figure 13:
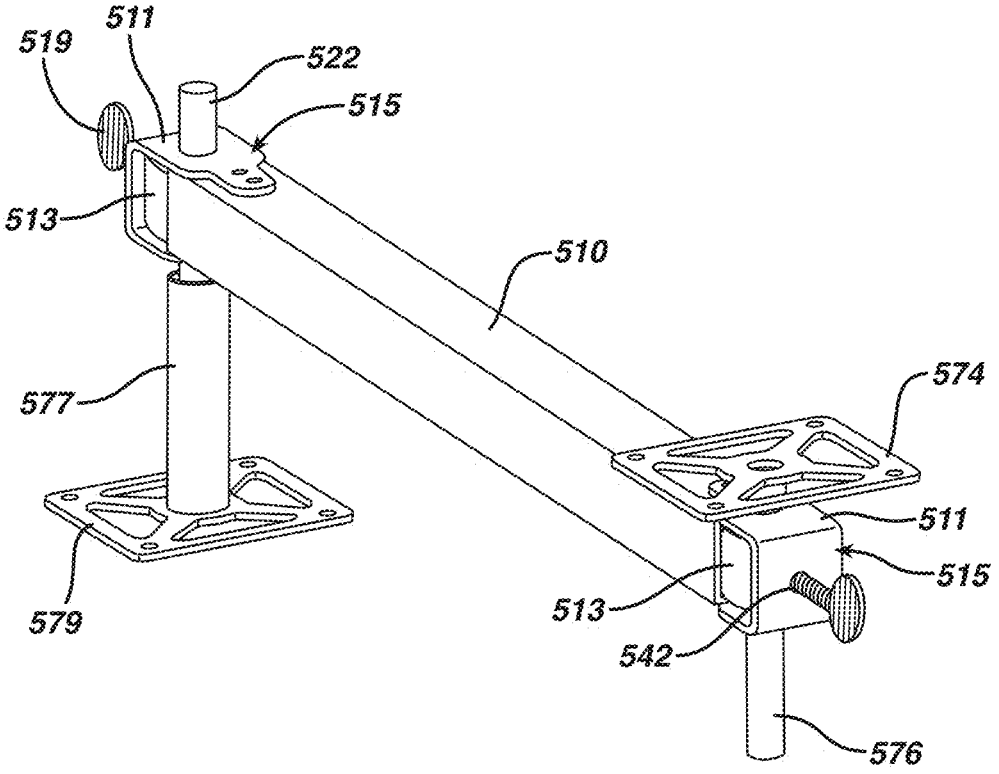
FIG. 13 is a perspective view of an alternate embodiment of the articulating portion.

Referring to FIGS. 7-9 and 12, the implement tray system 500 has a pair of arms 510, 512 with multiple pivot points to allow the user to easily manipulate the position of tray 570. Arm 510 is pivotably mounted at its proximal end to a base 530 and pivotably joined at its distal end to arm 512. Base 530 is designed to be attached on either a vertical surface (FIG. 11) or a horizontal surface (FIG. 12). Clamp 550 can be attached to base 530 that allows the implement tray 500 to be mounted to a table edge 517 (FIG. 6). Clamp 550 may optionally include leveling screws 616 as shown in FIG. 7E. Cylindrical member 520 allows for height adjustment. Referring to FIG. 9, setscrew 540 applies a force to cylindrical member 520, to maintain the cylindrical member 522 at a desired height relative to the base 530. Setscrew 540 also allows the cylindrical member to be easily disassembled from the base 530 for sterilization and/or packing for transport.

Pivoting of the arm 510 with respect to the base is controlled by a fitting 515 through which the cylindrical member 522 extends. Referring to FIG. 12, the fitting 515 includes a generally C-shaped bracket 511 that is attached to the end of the arm 510 and defines an opening for a setscrew 241 (not shown), and a friction sleeve 513 in the form of a generally U-shaped strip of flexible material (e.g., metal) that is pressed into the open end of arm 510 such that it the friction sleeve is arranged generally perpendicular to the bracket 511. The friction sleeve is preferably formed of a resilient material and is held in place by the outward force of the friction sleeve against the inner surface of the arm 510. The freedom of rotation of the arm 510 with respect to the base 530 can be adjusted by loosening and tightening the setscrew 519 which bears upon the friction sleeve 513 which in turn bears upon cylindrical member 522. The friction sleeve helps to distribute the force of the setscrew against the cylindrical member 522 and prevents slippage of the setscrew, which could occur if the setscrew directly contacted the cylindrical member.

Each end of the arms 510 and 512 has a fitting 515 that is configured in this manner, to receive cylindrical members 520, 522 and allow the freedom of rotation of arms 510 and 512 to be adjusted. This allows the user to adjust how easily the position of the tray 574 can be adjusted to suit the user's personal preference. Cylindrical member 520 serves as a pivot point for both arm 510 and arm 512. Each fitting 515 has a setscrew 519 (FIG. 7A) that allows the vertical and rotational positions of arms 510 and 512 to be adjusted. The fittings and the use of the cylindrical members to join the arms also allows the system 500 to be easily and completely disassembled for autoclaving and/or for transport and storage. Because all that is required for disassembly is loosening the setscrews, generally no tools are required for disassembly.

Referring to FIG. 11, tray 570 has mount 574 permanently affixed to the underside. Cylindrical member 576 extends from mount 574 and is configured to be received by fitting 515. Cylindrical member 576 allows rotation of the tray 570 and allows the tray to be easily removed for sterilization and/or transport.

Figure 7A:
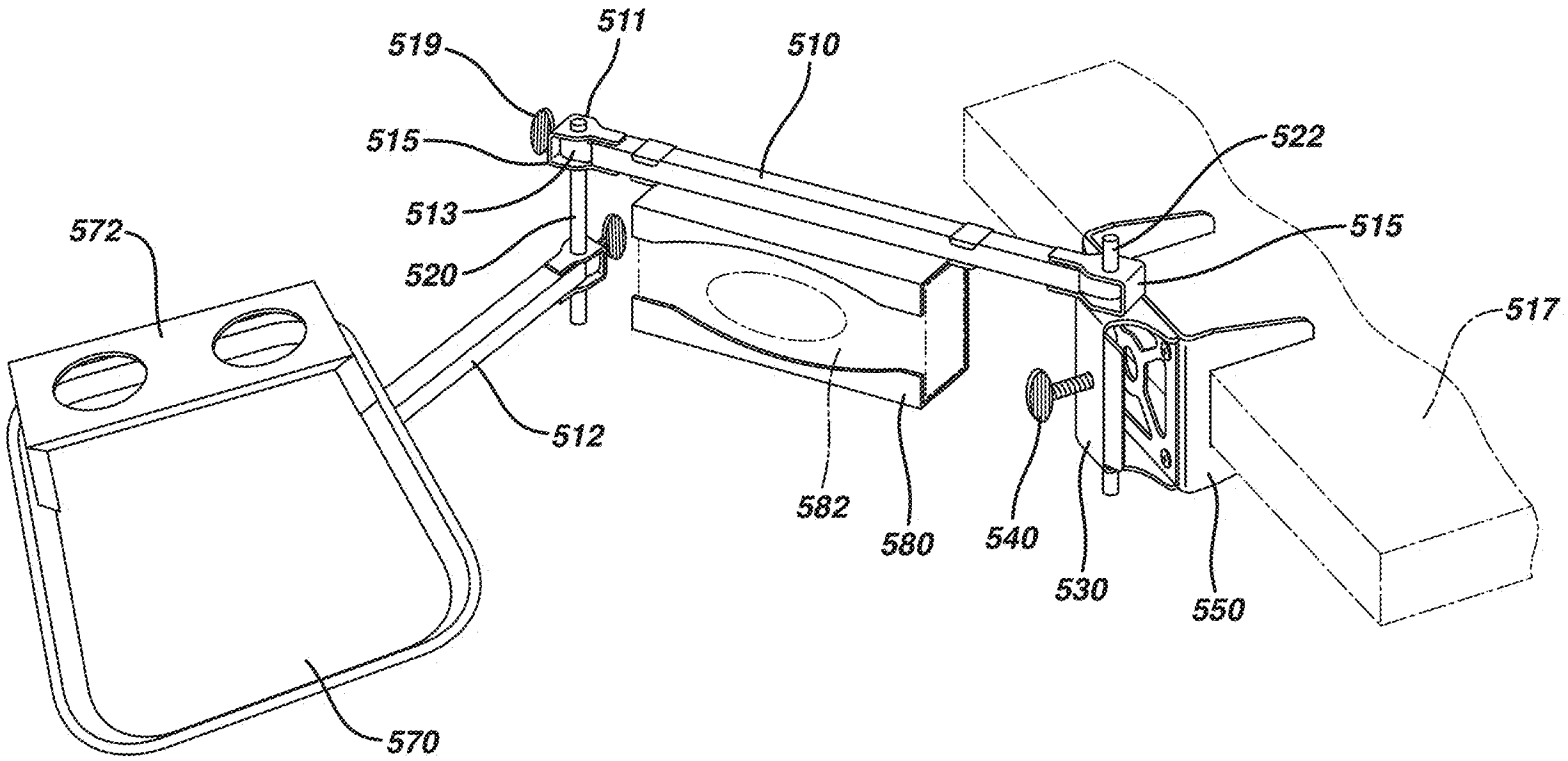
FIG. 7A is a perspective view of an implement tray system attached to a horizontal surface.
Figure 7B:
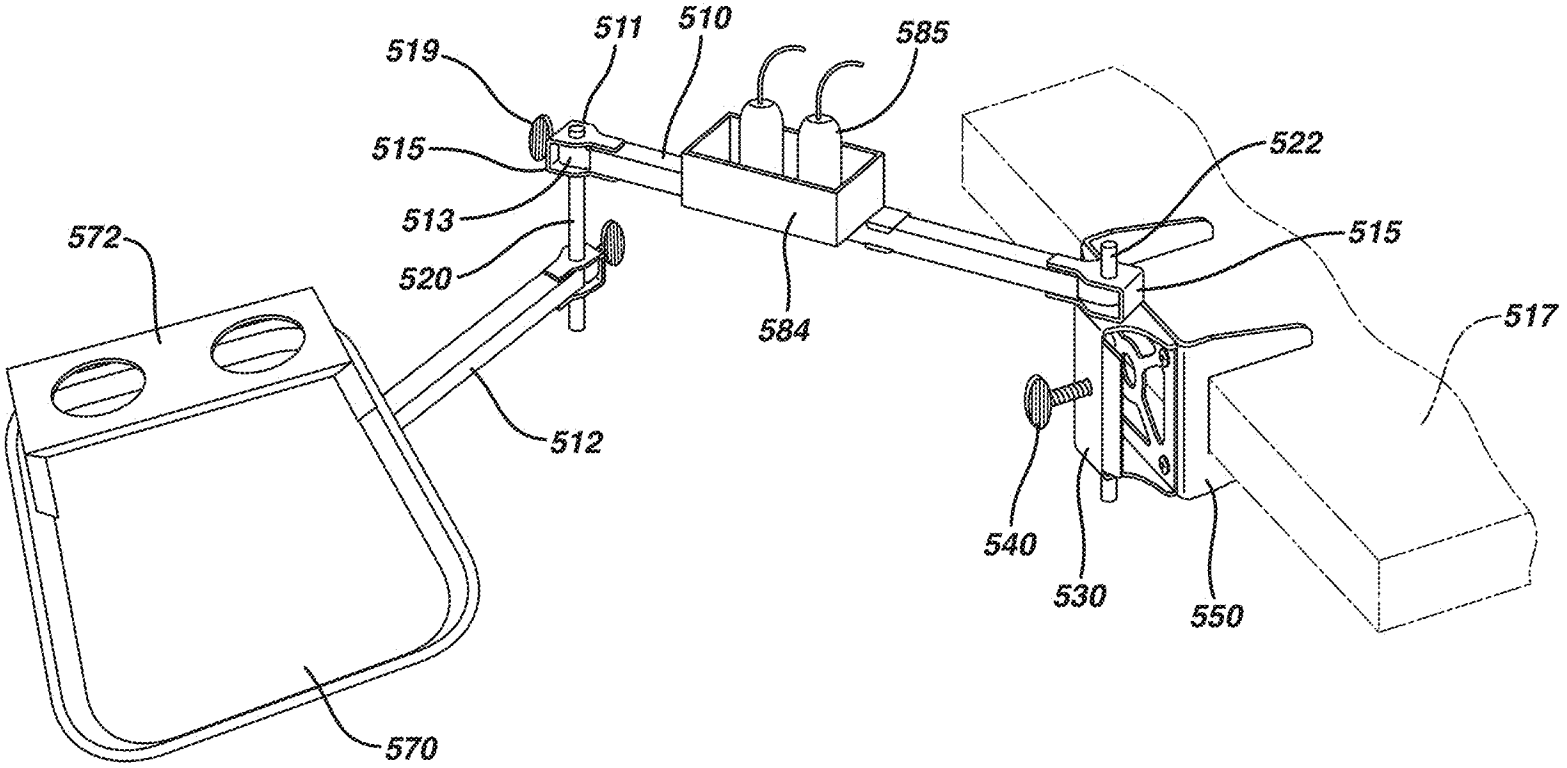
FIGS. 7B-7E are the same as FIG. 7A except that different accessories are provided with the implement tray system.
Figure 7C:
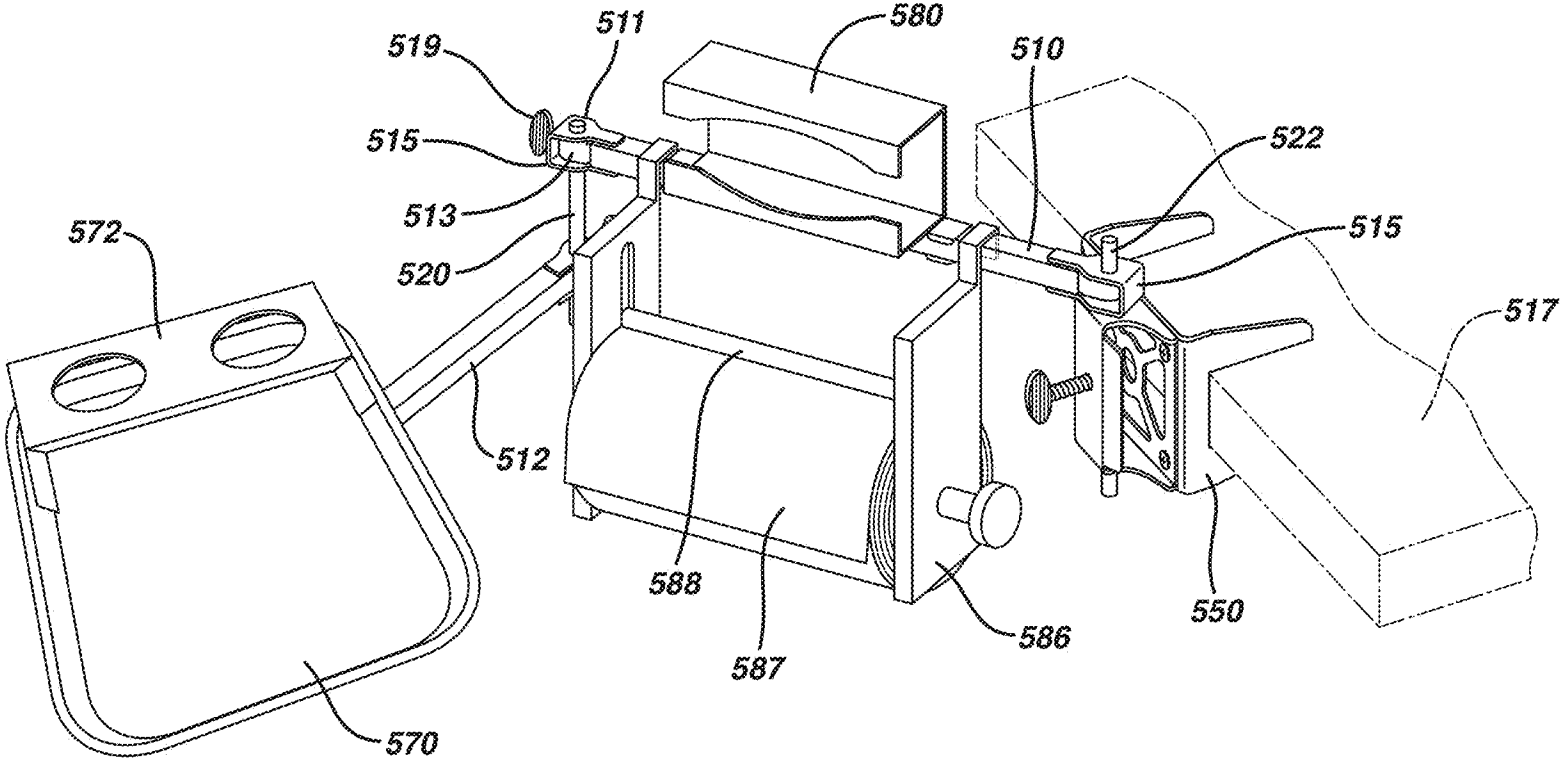

Referring to FIG. 7A, tray accessory 572 is configured to rest on top of tray 570. Tray accessory 572 is configured to position procedure accessories. Arm accessory 580 is configured to removably attached to arm 510. Arm accessory 580 is configured to hold a box of procedure gloves 582.

Figure 7D:
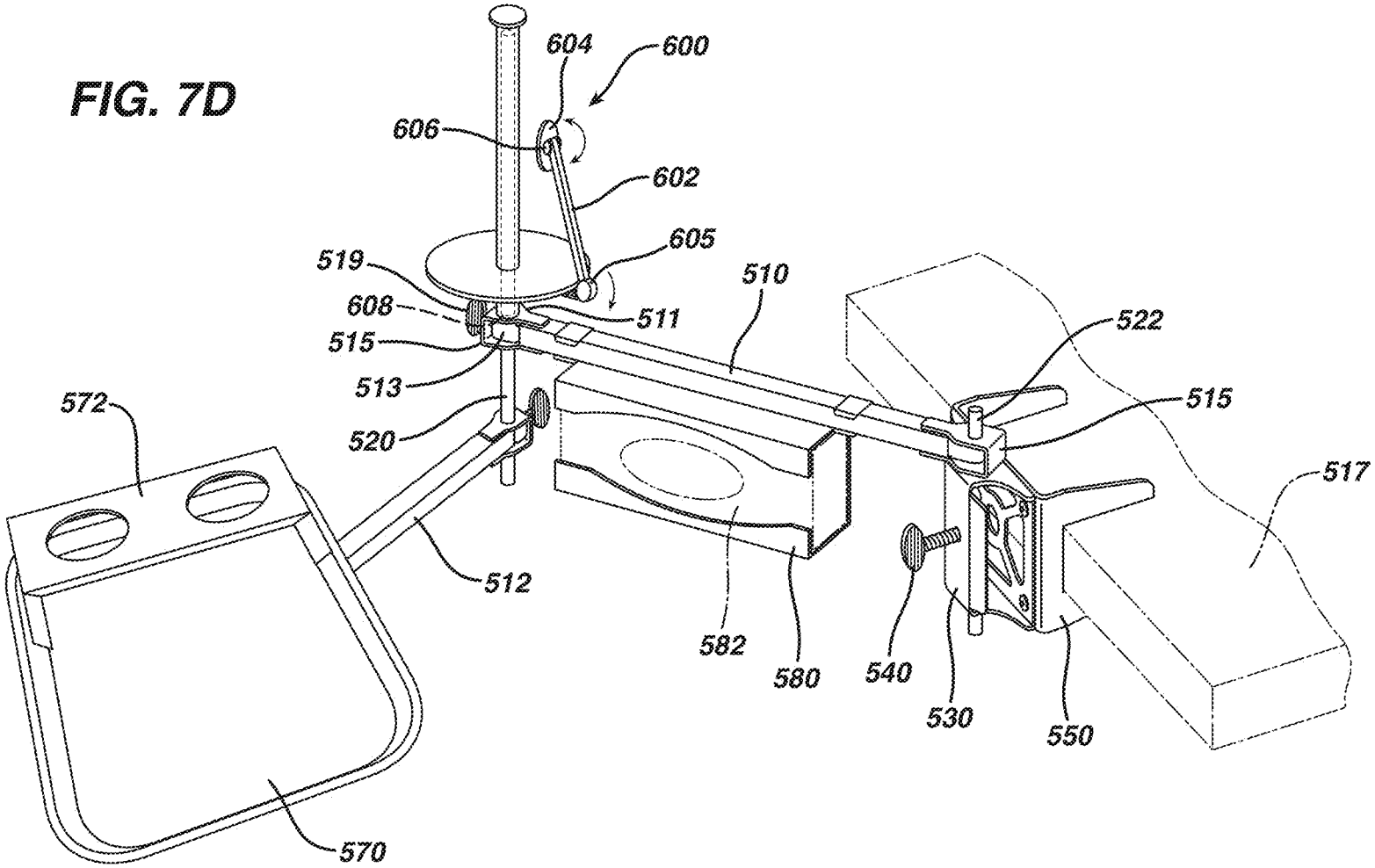
Figure 7E:
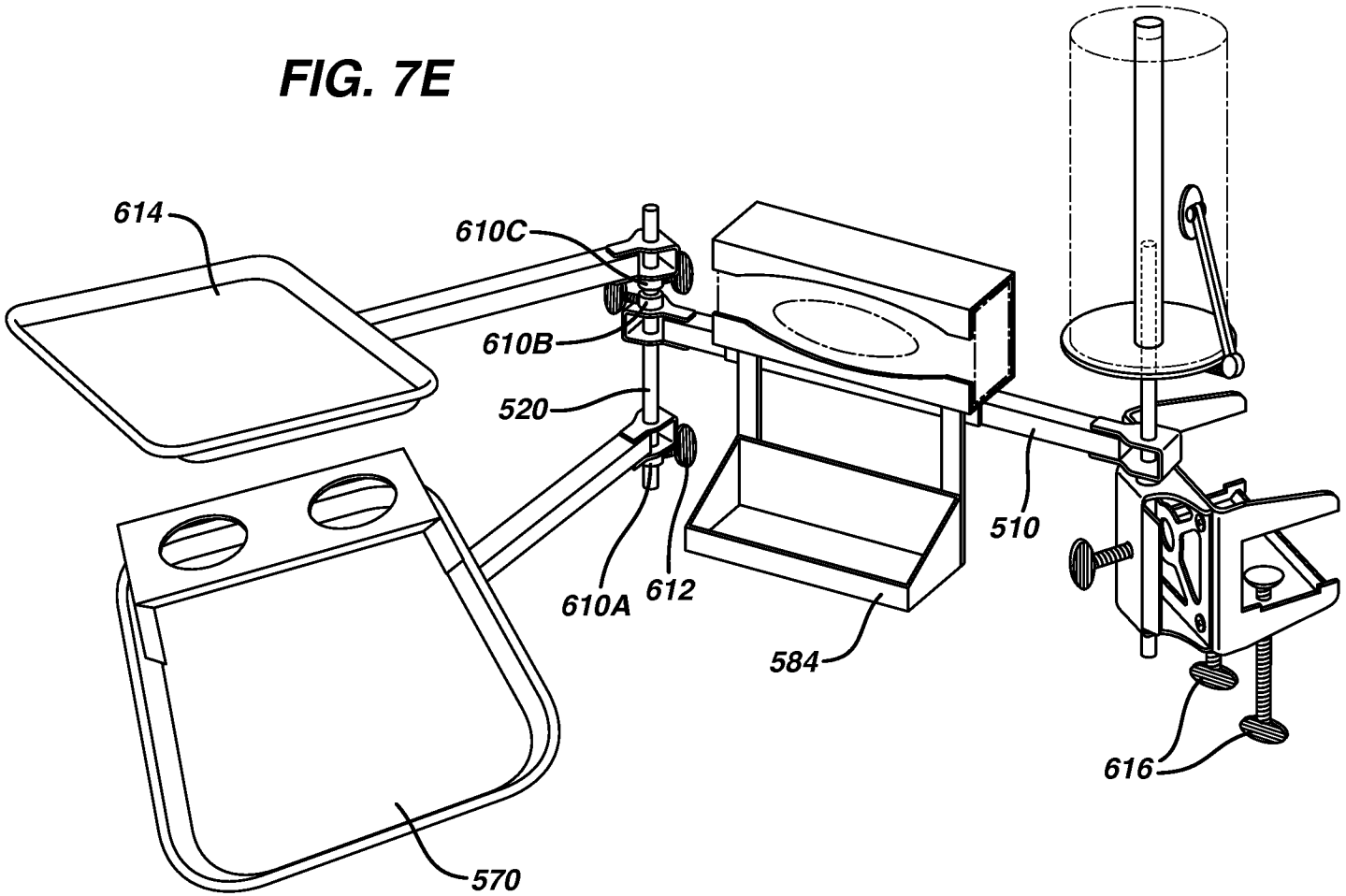
Figure 8:
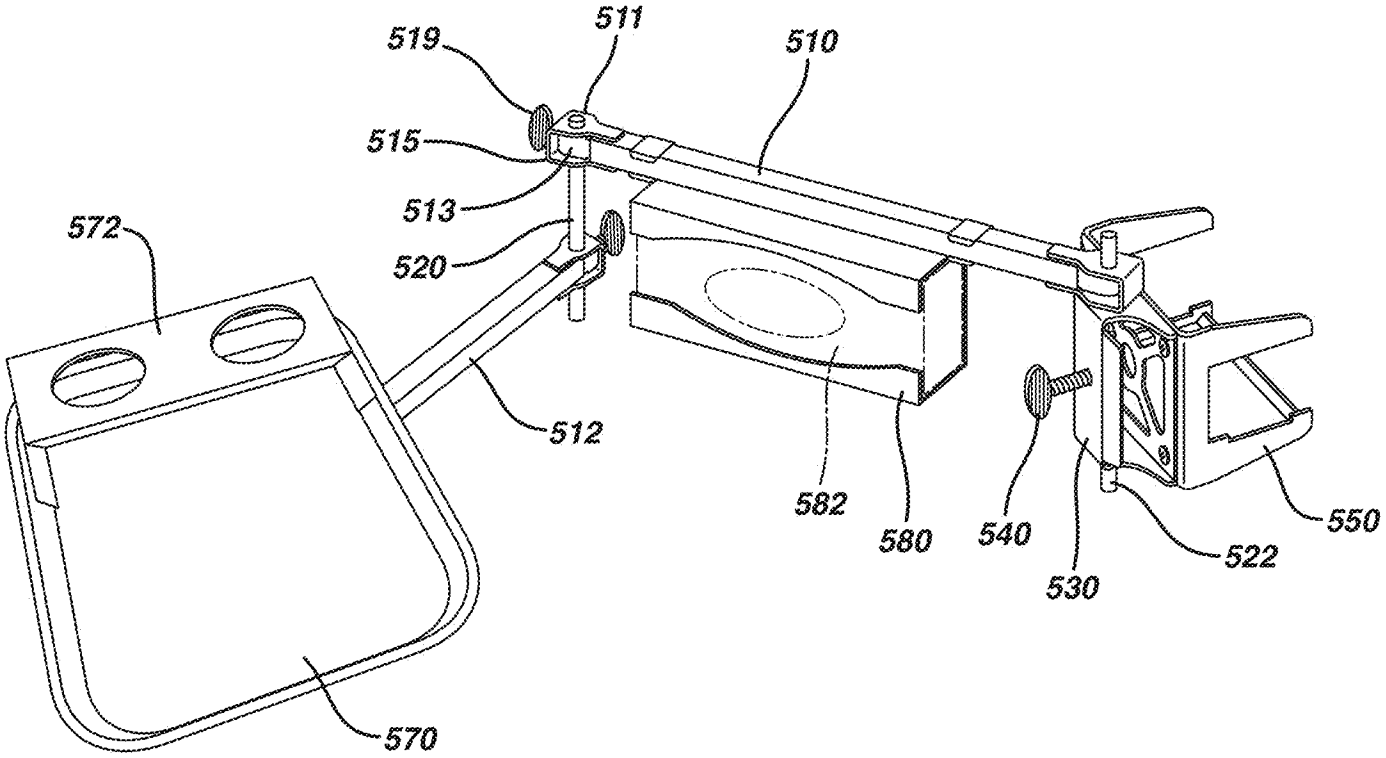
FIG. 8 is a perspective view of the implement tray system.

Additional accessories can be configured to removably attach to arm 510. For example, referring to FIG. 7B, supply container 584 is configured to hold treatment vessel 585, e.g., a squirt bottle or other work bottle that may be filled with various liquids. Alternatively the supply container may be disposed below the arm 510, as shown in FIG. 7E, as a hanging shelf. The accessories are designed to work in coordination with each other and can, in some cases, be attached to the same arm or on separate arms, e.g., using sliding, generally C-shaped clips as shown. For example referring to FIGS. 7C and 7D, arm accessory 580 is shown in two different orientations with respect to arm 510, above and below the arm. Horizontal towel holder 586 (FIG. 7C) removably attaches to arm 510 and is configured to dispense rolled paper towels 587. Friction bar 588 puts a force on the rolled paper towels 587 in a downward direction so that the paper towel roll will not completely unroll when extracting a singe towel. FIG. 7D shows a vertical rolled towel dispenser 600 that has a bore 608 that is configured to receive cylindrical member 520. Friction arm 602 is pivotably mounted on vertical rolled towel dispenser 600 by pivot 605. Friction foot 604 is pivotably mounted on the distal aspect of friction arm 602 by pivot 606. Pivot 605 is configured with a spring that biases friction arm 602 toward the center of the vertical rolled towel dispenser 600. This bias, in coordination with friction foot 604, allows the user to selectively remove one or more sheets from the roll (not shown) without unspooling the roll. Spring-biased pivots are well known in the art.

Referring to FIG. 7E, in some implementations an additional tray 614 can be mounted on cylindrical member 520. If desired other trays or accessories could be mounted on a single cylindrical member. The orientations of trays 614 and 570 can be adjusted by the practitioner for easy access to tools. Collars 610A, 610B, and 610C are positioned on cylindrical member 520 to maintain the vertical positioning of the arms on the cylindrical member 520. Collar 610B maintains the position of the vertical member 520 with respect to arm 510. The collars are secured in place by tightening set screw 612 against cylindrical member 520.

It should be understood that the accessories can be arranged in any configuration that best accommodates the user's need. Advantageously, all of the accessories are easily removable from the arm 510 for sterilization, replacement, or interchangeability.

Preferably all materials used in the system 500 are autoclavable. For example, the system may be made entirely of Stainless Steel, or a combination of Stainless Steel and other autoclavable materials such as sterilizable plastics.

Lighting Systems

FIGS. 14-18 show lighting systems that are designed to allow the position of a light source to be widely adjustable to enhance the visibility of a treatment surface on a subject. The lighting systems can be mounted at a convenient location, and then the light source can be positioned to provide optimal illumination of the treatment surface without adversely affecting treatment surface access, ergonomics or comfort of the practitioner. The systems are also designed to allow all components of the system to be sterilized and/or protected (e.g., by a disposable wrap), and to allow the system to be portable and mounted in a variety of different ways.

Figure 14:
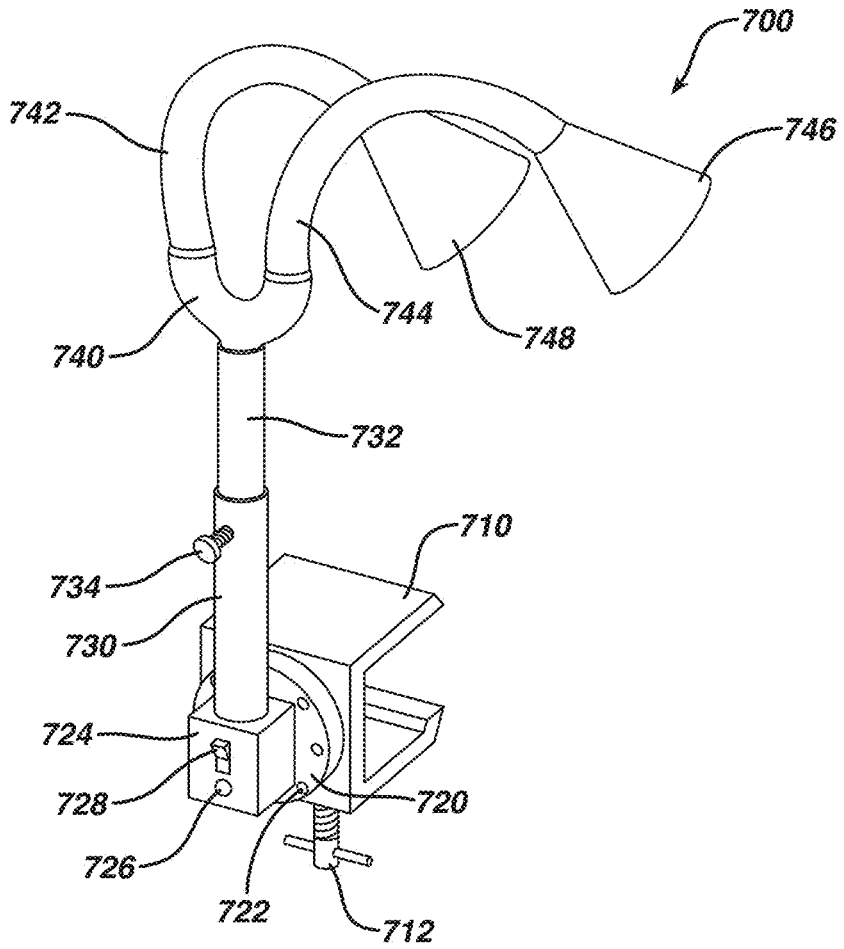
FIG. 14 is a rear, perspective view of a lighting system.
Figure 14A:
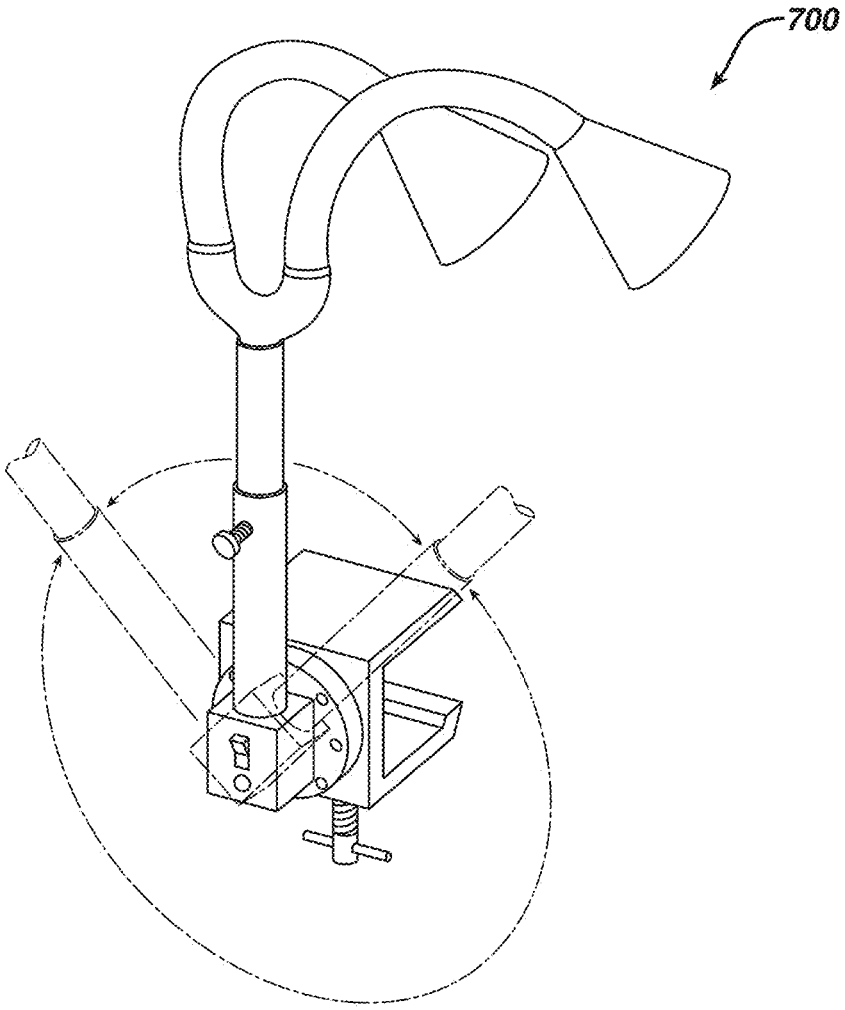
FIG. 14A is a perspective view of the lighting system in FIG. 14 showing its range of motion.

Referring to FIGS. 14-14A, lighting system 700 includes a pair of lights 746, 748, that are mounted at the distal end of a positioning system that allows the position of the lights to be adjusted both rotationally and linearly, and also allows fine adjustments to be made during application of a treatment to a subject.

The lighting system has a clamp 710 that is configured to removably secure the lighting system to a variety of horizontal and vertical surfaces, e.g. a table edge. A base 720 is affixed to clamp 710. Base 720 rotates with respect to clamp 710 to predetermined positions as shown in FIG. 14A, allowing the lights 746, 748 to be rotated about an axis of rotation that is generally perpendicular to the long axis of telescoping member 732 on which the lights are mounted. The rotational position of the base with respect to the clamp can be fixed by any desired method, e.g., by a plurality of spring loaded stops on the clamp and spaced receiving openings 722 on the base.

Support member 730 extends from base 720 and receives telescoping member 732 on which the lights are mounted. Telescoping member 732 allows the user to adjust the distance between the lights and the base. Setscrew 734 releasably fixes the position of telescoping member 732 with respect to support member 730.

Neck mount 740 attaches telescoping member 732 to flexible necks 742, 744. Flexible necks 742, 744, which may be, for example, gooseneck tubing, allow the user to easily direct light on the surface that is to be treated. The necks allow fine adjustments to be made easily even while the practitioner is applying a treatment.

Power wires that connect the power, e.g., a battery, and the lights 746, 748, are routed internally to allow for unencumbered adjustment and enable easy sterilization.

Base 724 houses a rechargeable battery (not shown), e.g. a lithium ion battery or similar, that can power the light source independently of an external power source. This is advantageous, for example, when the lighting system is going to be used at a remote location (trade show, sporting event, etc.) but is also useful insofar as it eliminates a power cord that could constitute a tripping hazard. Base 724 further includes a switch 728 that turns the lights 746, 748 on and off and charging receptacle 726. Receptacle 726 allows a cord (not pictured) to be removably attached to light base 724.

It is preferred that the lighting system include two lights, as shown, as multiple, independent light sources eliminate shadows on the treatment surface and reduce practitioner eyestrain. Preferably, lights 746, 748 are full spectrum so that the treatment surface is viewed without color loss.

Figure 15:
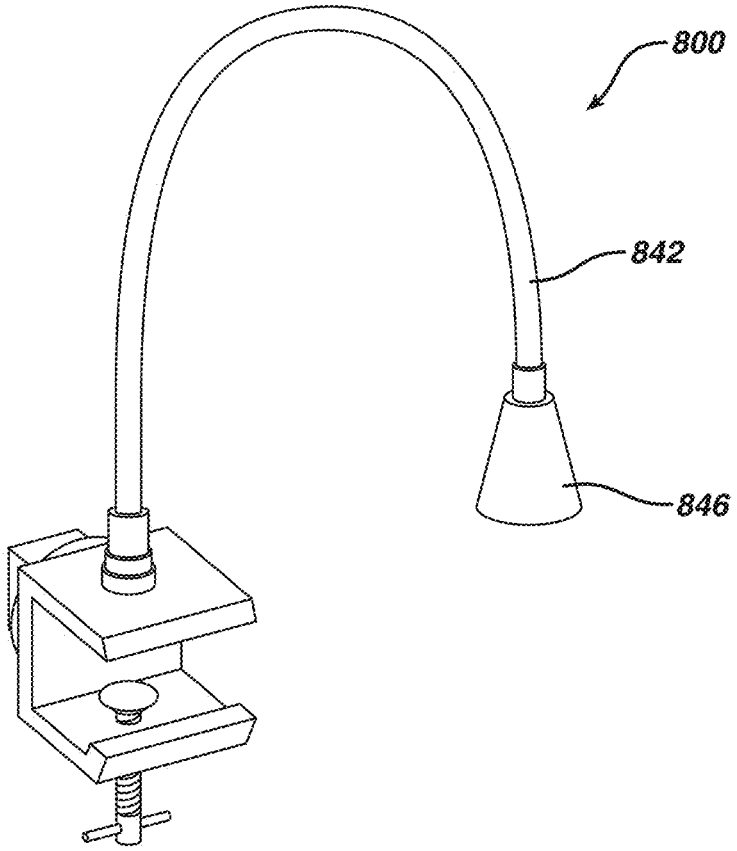
FIG. 15 is a rear, perspective view of a lighting system according to another embodiment.
Figure 16:
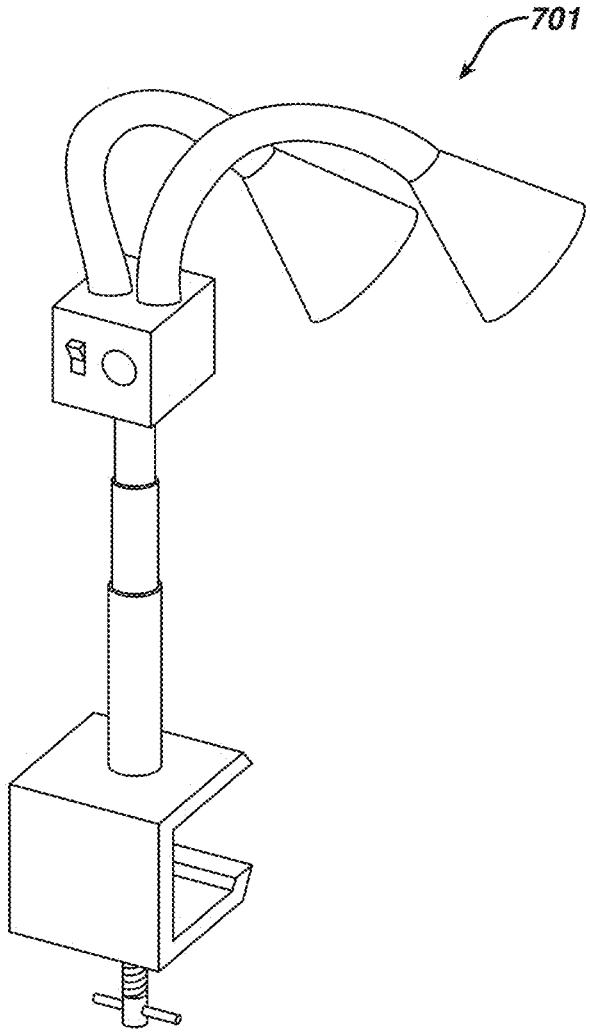
FIG. 16 is a perspective view of a lighting system according to another embodiment.

Referring to FIG. 16, in another embodiment lighting system 900 is configured with a plurality of telescoping members 930, 932, 934. This configuration allows the user to easily adjust the distance of the light from the base to a greater extent, as shown in FIG. 17. The lighting system 900 also includes a T-shaped light mount consisting of telescoping member 934 and yoke 940, which allows necks 942 and 944 to be positioned further apart than the necks in the embodiments shown in FIGS. 14-15. In the embodiment shown in FIG. 16, the switches for turning the lights on and off and dimming the lights are positioned on the yoke 940, which may make it easier to reach the switches during a treatment and which eliminates the necessity to run wiring through the telescoping portion of the device. This feature can be included in other embodiments of the lighting system, e.g., with gooseneck tubing or other telescoping arrangements.

If desired, the telescoping arrangement and short necks shown in FIGS. 14-16 can be replaced by a continuous length of gooseneck tubing 842 supporting a single light 846, as in lighting system 800 shown in FIG. 18. In this embodiment, rotation of the base is still about an axis that is generally perpendicular to a long axis of the light support—in this case the long axis of the lower, straight portion of the tubing 842.

Preferably the lighting system can be sterilized by autoclaving or similar. For example, the system may be made entirely of Stainless Steel, or a combination of Stainless Steel and other autoclavable materials such as sterilizable plastics.

Additionally, the lighting system may be designed to be disassembled so that it may be more easily transported.

Other Embodiments

A number of embodiments have been described. Nevertheless, it will be understood that various modifications may be made without departing from the spirit and scope of the disclosure.

For example, while the implement tray shown in FIGS. 7-13 includes only two arms, if desired three or more arms may be provided. Preferably all arms are connected using the same system of rods and fittings having receiving openings.

Moreover, while cylindrical rods are shown in FIGS. 7-13, other shapes of rods and corresponding opening shapes may be used, e.g., rods having square or rectangular cross-sectional shapes.

Accordingly, other embodiments are within the scope of the following claims.

What is claimed is:

1. An implement tray system comprising:

an elongated arm member having two ends and a receiving opening at each end, a tray having a bottom surface, a first elongated cylindrical support member extending from the bottom surface of the tray generally perpendicular to the surface, the support member being removably received in one of the receiving openings, mounting the tray on the elongated arm member, a second elongated cylindrical support member that is removably received in the other of the receiving openings, and a friction fitting disposed at each end of the elongated arm member, each friction fitting comprising a generally U-shaped friction sleeve having ends disposed within the elongated arm member and a central portion in contact with the cylindrical support member, and a setscrew that bears upon the central portion such that pressure applied by the setscrew is distributed over an area of the cylindrical support member that is in contact with the central portion.

2. The system of claim 1 further comprising a second elongated arm member having two ends and a receiving opening at each end, wherein the second cylindrical support member is removably received in one of the openings in the second elongated arm member.

3. The system of claim 2, wherein the receiving openings of the first and second elongated support members all have the same diameter.

4. The system of claim 1, wherein each friction fitting further comprises a bracket that is fixedly mounted to the end of the elongated arm member and that defines the receiving opening, wherein the friction collar is disposed within the bracket and the setscrew extends through an opening in the bracket.

5. The system of claim 1, wherein each friction sleeve is formed of a resilient material.

6. The system of claim 5, wherein the ends of each friction sleeve are held in place within the elongated member by an outward force exerted by the ends against inner surfaces of the elongated arm member.

7. The system of claim 6, further comprising a third elongated arm member having two ends and a receiving opening at each end, wherein the second cylindrical support member is removably received in one of the openings in the third elongated arm member.

8. The system of claim 7, further comprising a second tray, having a bottom surface, and a third cylindrical support member extending from the bottom surface, the third cylindrical support member is removably received in the other opening in the third elongated arm member.

9. The system of claim 1, further comprising a support collar positioned around the second elongated cylindrical support member below the friction fitting to prevent vertical slippage of the elongated arm member relative to the cylindrical support member.

* * * * *